US011879701B2

(12) United States Patent
Martinez

(10) Patent No.: US 11,879,701 B2
(45) Date of Patent: Jan. 23, 2024

(54) AUTOMATIC RELOADING DEVICE FOR A WEAPON WITH A DOUBLE AMMUNITION MAGAZINE, AND WEAPON SYSTEM COMPRISING IT

(71) Applicant: NEXTER SYSTEMS, Versailles (FR)

(72) Inventor: Yves Martinez, Bourges (FR)

(73) Assignee: NEXTER SYSTEMS, Versailles (FR)

( * ) Notice: Subject to any disclaimer, the term of this patent is extended or adjusted under 35 U.S.C. 154(b) by 0 days.

(21) Appl. No.: 17/940,829

(22) Filed: Sep. 8, 2022

(65) Prior Publication Data

US 2023/0184501 A1 Jun. 15, 2023

(30) Foreign Application Priority Data

Sep. 10, 2021 (FR) ..... 2109442

(51) Int. Cl.
*F41A 9/11* (2006.01)
*F41A 9/37* (2006.01)
*F41H 7/02* (2006.01)

(52) U.S. Cl.
CPC ..... *F41A 9/11* (2013.01); *F41A 9/37* (2013.01); *F41H 7/02* (2013.01)

(58) Field of Classification Search
CPC ..... F41A 9/10–23; F41A 9/37
See application file for complete search history.

(56) References Cited

U.S. PATENT DOCUMENTS 3,986,432 A 10/1976 Schreckenberg
3,988,962 A * 11/1976 Elwin ..... F41A 9/54 89/46
4,388,854 A * 6/1983 Dabrowski ..... F42B 39/20 89/34
4,727,790 A * 3/1988 DeHaven ..... F41A 9/21 89/46
H793 H * 7/1990 Zangrando ..... F41A 9/21 89/46
5,261,310 A * 11/1993 Sullivan ..... F41A 9/21 89/46

FOREIGN PATENT DOCUMENTS

DE 3328208 A1 6/1986
EP 0051119 A1 5/1982
FR 2245925 A1 4/1975
FR 3092907 A1 8/2020
WO 2020/165792 A1 8/2020

OTHER PUBLICATIONS

May 21, 2022 Search Report and Written Opinion issued in French Patent Application No. 2109442.

* cited by examiner

*Primary Examiner* — Bret Hayes
(74) *Attorney, Agent, or Firm* — Oliff PLC

(57) ABSTRACT

An automatic reloading device for a weapon fed by two ammunition magazines includes first and second ammunition conveyors, each movable in phase opposition between a position for collecting a piece of ammunition from a magazine and a position for reloading the weapon. The automatic reloading device includes a single actuator, able to output an alternating motion, and movement devices for transmitting the alternating motion to the first and second ammunition conveyors and converting it into movements of the first and second ammunition conveyors for an alternating feeding of the weapon. A weapon system can include such an automatic reloading device.

12 Claims, 6 Drawing Sheets

[Fig. 1]
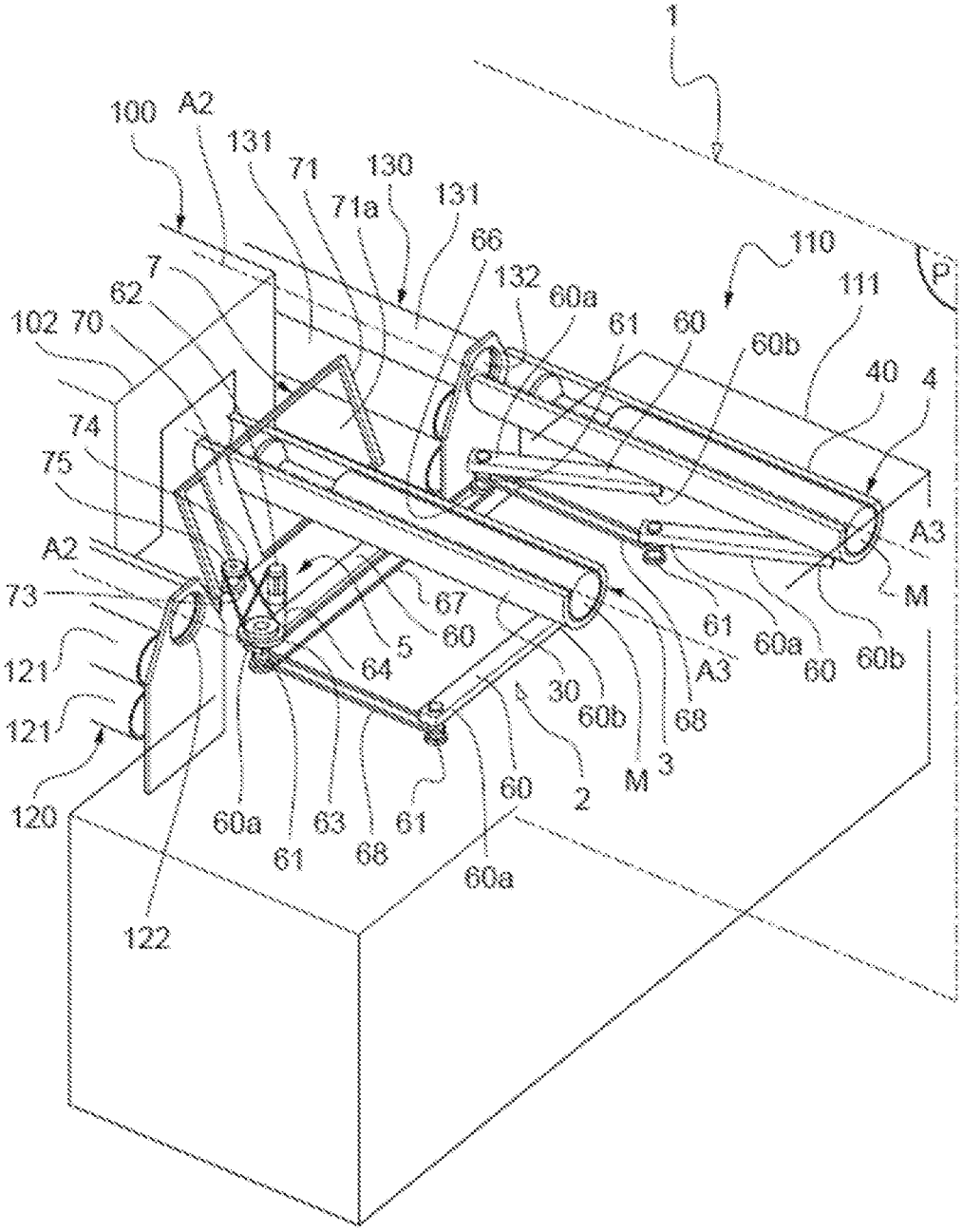

[Fig. 2]
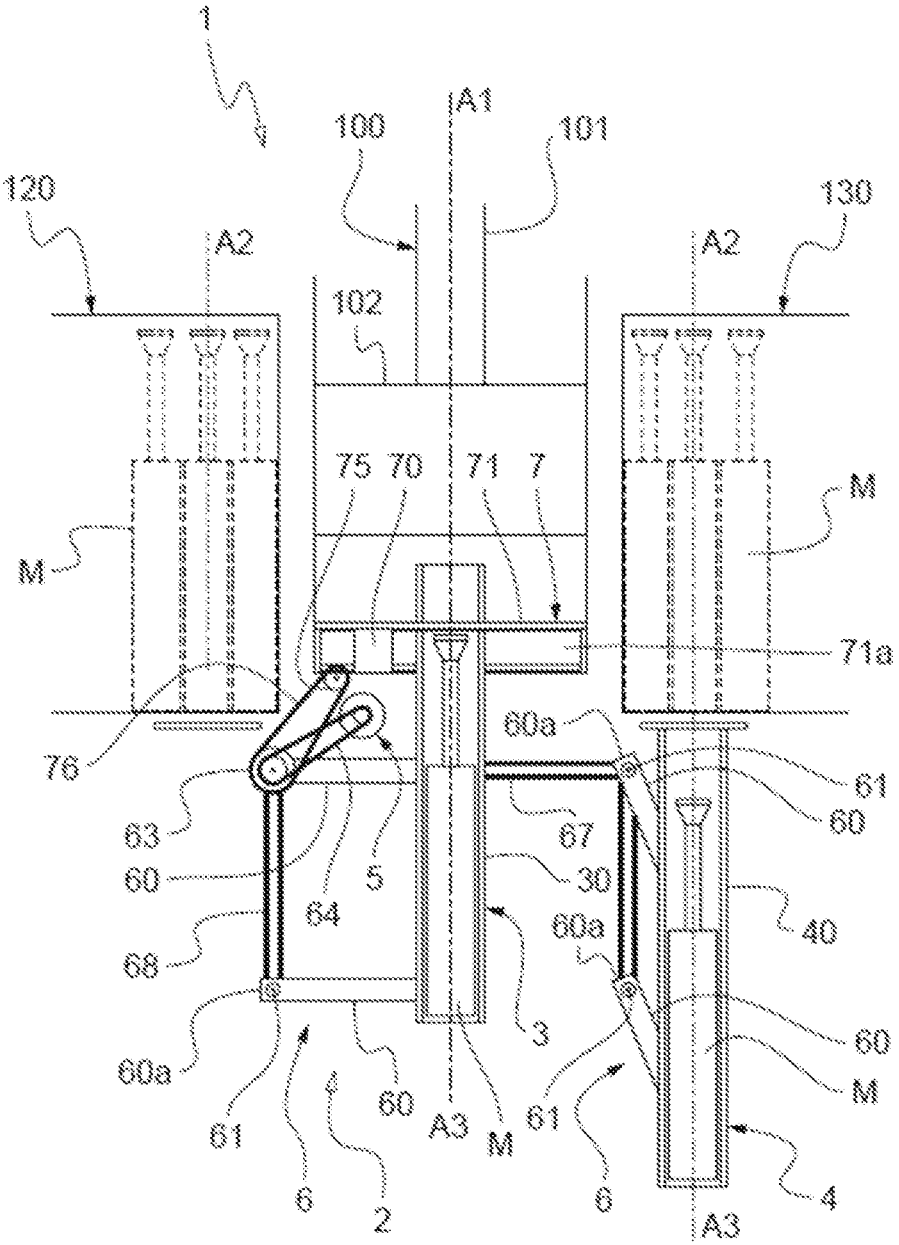

[Fig. 3]
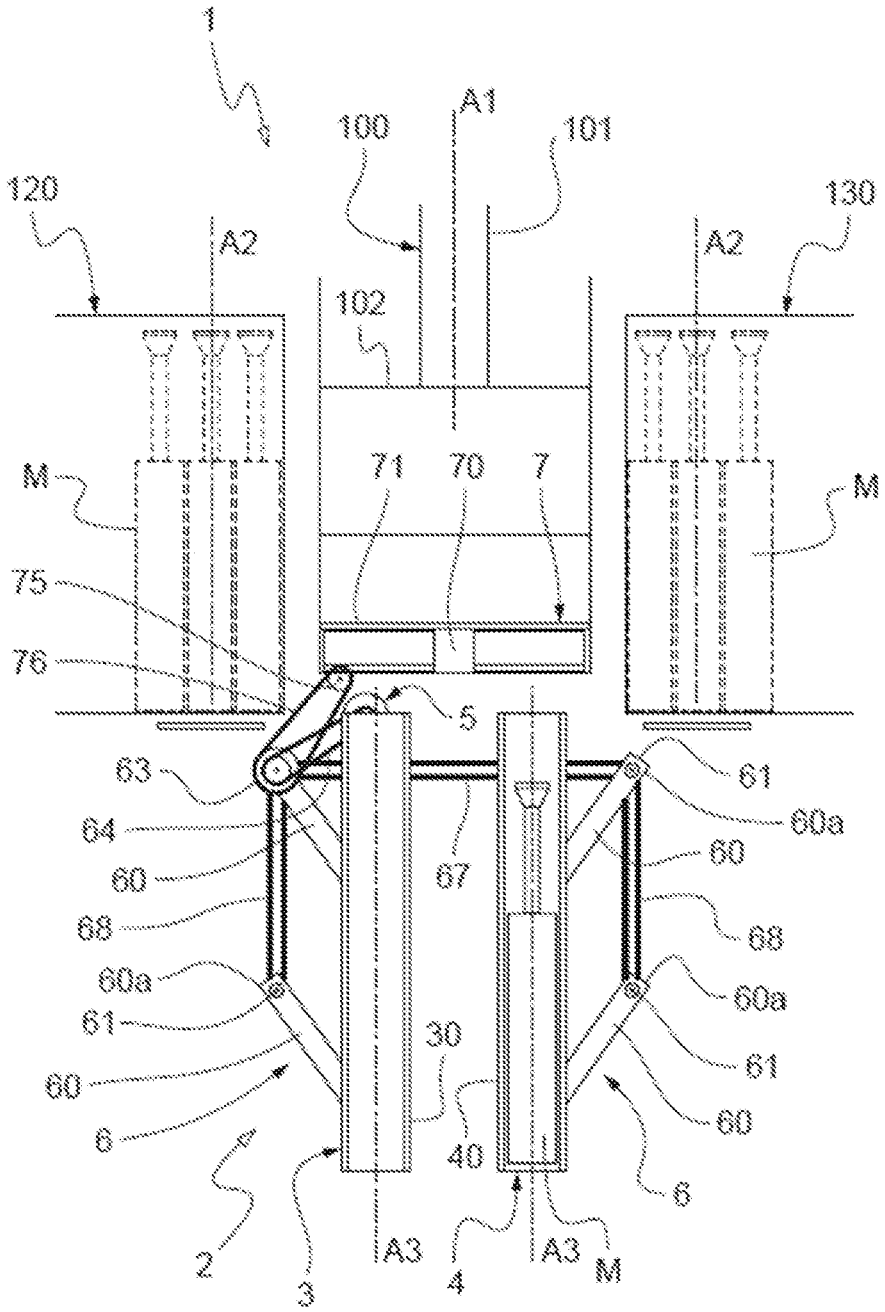

[Fig. 4]
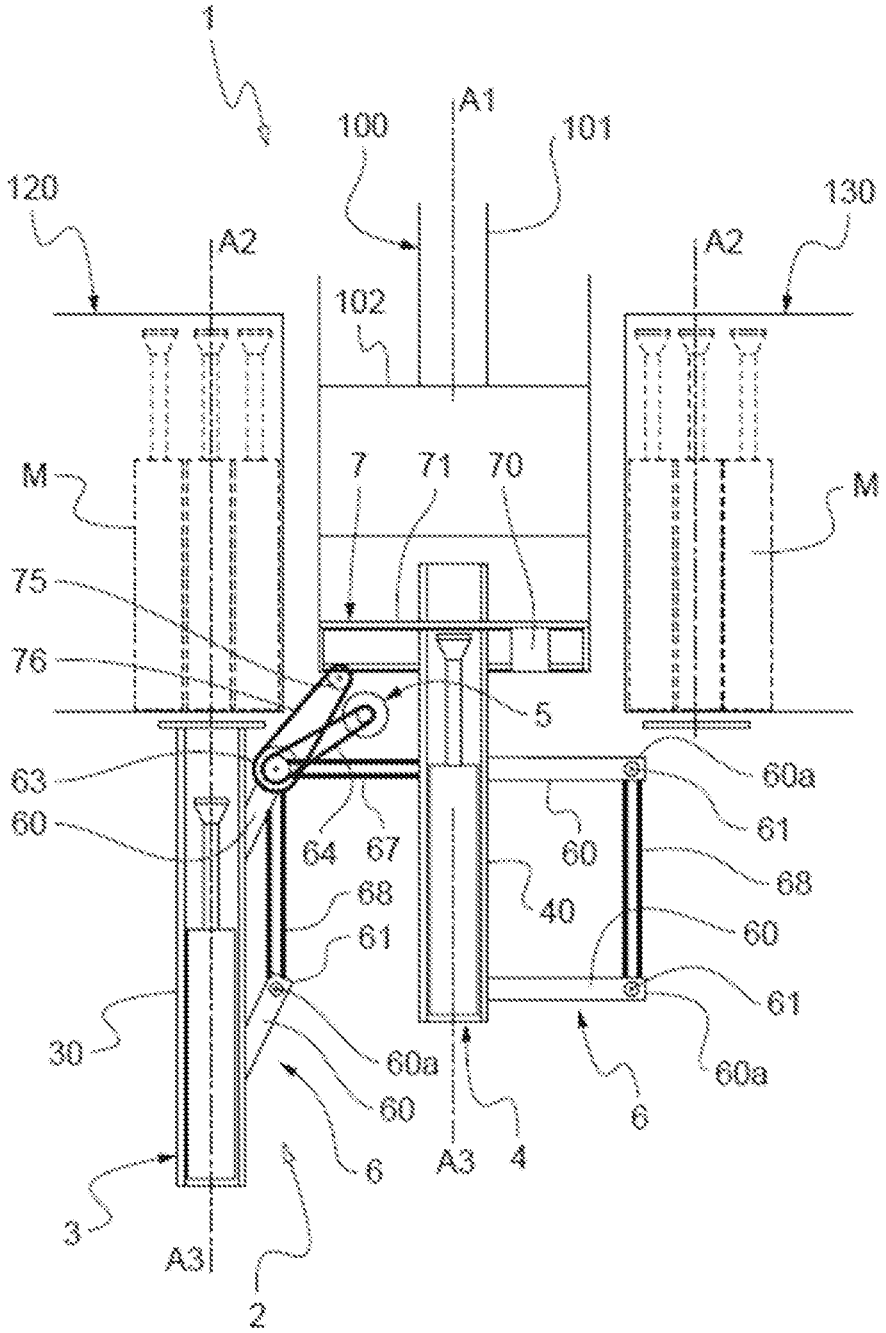

[Fig. 5]
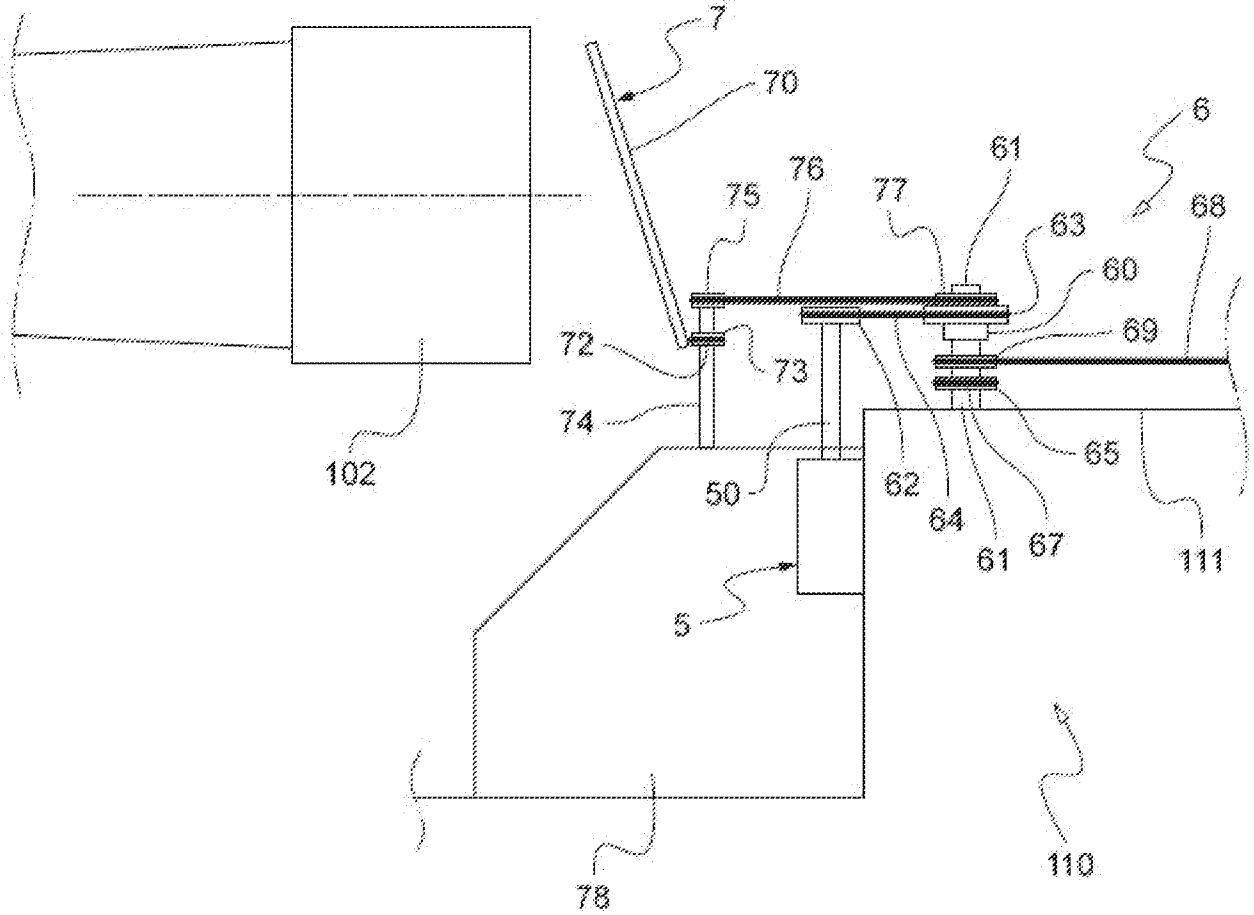

[Fig. 6]
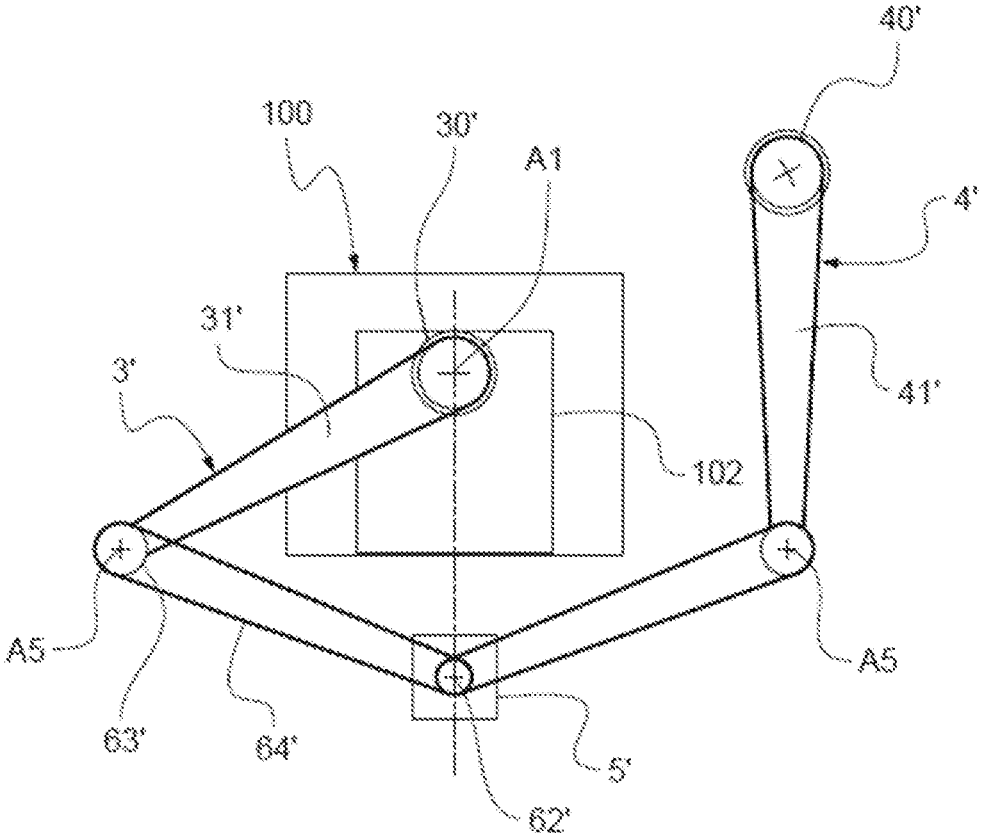

AUTOMATIC RELOADING DEVICE FOR A WEAPON WITH A DOUBLE AMMUNITION MAGAZINE, AND WEAPON SYSTEM COMPRISING IT

BACKGROUND OF THE INVENTION

Field of the Invention

The technical field of the invention is that of automatic reloading systems for large-caliber breech-loading weapons, and more particularly for large-caliber weapons of weapon systems such as turrets of armored vehicles or artillery pieces.

The present invention relates in particular to an automatic reloading device for a weapon with dual ammunition magazine feed, i.e., whose ammunition feed is provided by two ammunition magazines, and to a weapon system comprising it.

Description of Related Art

It is known to equip a turret with an automatic reloading device configured to take ammunition from two ammunition magazines. In this type of loading system, the ammunition is either taken first from one of the magazines and then from the other when the first is empty, or taken alternately from one and the other.

German Patent DE 3,328,208 A1 describes a reloading device for use with two rotating ammunition magazines, referred to as barrels, arranged on either side of the weapon and each intended for holding ammunition to alternately feed a weapon. The reloading device includes a single ammunition conveyor that is associated with the two barrels.

French patent FR 2,245,925 B1 describes a reloading device for use with two flat ammunition magazines, arranged on either side of the weapon, and each magazine is associated with a feed means having a pivoting arm, the two feed means being mounted so as to be able to pivot alternately and moved by a dedicated hydraulic cylinder.

European Patent EP 0,051,119 B1 also describes a reloading device for use with two barrels disposed at the rear of the weapon. An ammunition conveyor is associated with each barrel and is capable of being pivoted by hydraulic-type drive means dedicated to the respective feed conveyor, between an ammunition collection position, adjacent to the associated barrel, and a ready-to-load position, adjacent to the weapon breech.

The reloading devices known from patents FR 2,245,925 B1 and EP 0,051,119 B1 ensure an alternating feeding of the weapon and thus allow to divide by half the reloading time during series of shots, compared to a reloading system not allowing such an alternate feeding, such as patent DE 3,328,208 A1.

The reloading devices of patents FR 2,245,925 B1 and EP 0,051,119 B1 however include two actuators for controlling the alternating movements of the two means or ammunition conveyors, with a dedicated actuator for each means or ammunition conveyor.

BRIEF SUMMARY OF THE INVENTION

Such a dual-actuator, and therefore dual-control, system is complex to control and expensive.

The purpose of the present invention is therefore to propose an automatic reloading device that is simple to control and inexpensive, while retaining the advantages provided by an alternating feeding of the weapon.

The solution according to the present invention is based on the use of a single actuator to move the two ammunition conveyors in phase opposition and in a synchronized manner, taking advantage of the fact that the two ammunition magazines and the movements of the two ammunition conveyors are symmetric with respect to the vertical plane passing through the axis of the weapon.

The present invention thus relates to an automatic reloading device for a weapon mounted on a weapon support and intended to be fed with ammunition by two ammunition magazines that are carried by the weapon support and that each have a collection area having a longitudinal axis along which, in use, a piece of ammunition to be loaded extends, the collection areas being symmetric on either side of a vertical plane of symmetry passing through the axis of the weapon, the device including first and second ammunition conveyors, each movable between a collection position, in which it is able to collect a piece of ammunition from a collection area of a respective one of the two ammunition magazines, and a ready-to-load position, in which it is able to load said piece of ammunition into a breech of the weapon, the device further including drive means for moving the first and second ammunition conveyors between the collection and ready-to-load positions in such a way as to ensure alternating feeding of the weapon by the first and second ammunition conveyors, the latter following trajectories that are symmetric with respect to said plane of symmetry, the movements of the first and second ammunition conveyors from the collection position to the ready-to-load position, and vice versa being identical, except for the symmetry, the device being characterized in that the drive means include a single actuator, secured to the weapon support and able to output an alternating motion, and movement means for transmitting the alternating motion to the first and second ammunition conveyors and converting it into movements of the first and second ammunition conveyors for an alternating feeding of the weapon.

It should be noted that the above-mentioned trajectories of the ammunition conveyors are the trajectories in the reference frame of the weapon support, and that the fact that the first and second ammunition conveyors have identical movements, except for the symmetry, means that the only difference between these movements, apart from the fact that they are carried out in a synchronized manner in phase opposition for an alternating feeding of the weapon, lies in their trajectories, which are symmetric, the speeds, accelerations, etc., of the ammunition conveyors being otherwise equal.

It is also pointed out that the weapon support can be the mobile part of a turret of an armored vehicle or the mount of an artillery piece.

The solution according to the present invention is not limited to a specific trajectory of the ammunition conveyor.

For example, ammunition conveyors similar to those described in patent EP 0,051,119 B1 can be provided, i.e., which pivot between the collection and ready-to-load positions. In order to ensure the alternating pivotings of the two ammunition conveyors, it is possible, for example, to place a single rotary actuator whose output shaft, which will be moved in an alternating motion, has its axis of rotation belonging to said plane of symmetry, and to provide, as movement means, two drive wheels mounted on the output shaft, and two links, such as chains, which are each wound, on the one hand, around a respective one of the drive wheels and, on the other hand, around a driven wheel secured to the pivot of the ammunition conveyor. The two ammunition conveyors will be arranged so that their alternating pivotings are in phase opposition and it is easily understood that when one of the ammunition conveyors pivots upwards, the other pivots downwards, and vice versa.

The person skilled in the art will be able to implement the actuator and the movement means in a large number of forms, taking into account the trajectories followed by the ammunition conveyors, without it being necessary to describe them all here.

Nevertheless, according to a particularly advantageous embodiment of the device according to the present invention, for a weapon intended to be fed with ammunition by two ammunition magazines whose collection areas have their longitudinal axes parallel to said plane of symmetry, the ammunition conveyors each have a longitudinal axis that belongs to a plane parallel to said plane of symmetry, and the movement means include, for each ammunition conveyor:

a pair of parallel connecting rods, of the same length and each having first and second ends articulated to the weapon support and to the ammunition conveyor, respectively, so as to form with the ammunition conveyor a deformable parallelogram in a theoretical plane that is secant with said plane of symmetry, the alternating movements of each of the first and second ammunition conveyors between the collection position and the ready-to-load position being obtained by alternating pivotings of the pair of connectings rods about their first ends; and connecting means connected to the actuator and to the deformable parallelogram so as to obtain said alternating pivoting of the pair of connecting rods when the actuator outputs said alternating motion.

The two theoretical planes in which the two deformable parallelograms move may be different. In such a case, the connecting means will be configured to take into account the angle formed between said theoretical plane and the plane in which the alternating motion is output by the actuator.

Advantageously, the two pairs of connecting rods form two deformable parallelograms in the same theoretical plane, preferably perpendicular to said plane of symmetry.

It may simply be provided that each connecting rod is further articulated to the weapon support and to the respective ammunition conveyor by means of pivot connections. This simple configuration is particularly suitable in the case where the ammunition magazines are positioned so that the longitudinal axis of each collection area is aligned with the longitudinal axis of the respective ammunition conveyor when the latter is in the collection position. In the ready-to-load position, alignment between the longitudinal axis of the ammunition conveyor and the axis of the weapon can generally be achieved by moving the weapon itself, which is at least orientable in elevation.

According to another particular embodiment, each ammunition conveyor could be articulated to the respective connecting rods in a manner that also allows the ammunition conveyor to be inclined in a plane parallel to said plane of symmetry to accommodate any inclination of the collection area in the collection position and/or of the breech of the weapon in the ready-to-load position. Alternatively, an ammunition conveyor could be provided which comprises a support articulated to the respective connecting rods by means of pivot connections and a cradle in which the ammunition is received and which can itself be inclined by any suitable means.

According to a particular embodiment, the actuator is a rotary actuator having a rotary output shaft whose longitudinal axis is parallel to the pivots of the pivot connections. The connecting means for the first ammunition conveyor include a first link, referred to as a drive link, connecting, on the one hand, a first drive wheel secured to the output shaft and, on the other hand, a first driven wheel secured to a pivot itself secured to the first end of one of the connecting rods articulated to the first ammunition conveyor. The connecting means for the second ammunition conveyor include a second link, referred to as a transmission link, connecting, on the one hand, a second driven wheel secured to a pivot itself secured to the first end of one of the connecting rods articulated to the first ammunition conveyor, preferably secured to the same connecting rod as the first driven wheel, and, on the other hand, a third driven wheel secured to a pivot itself secured to the first end of one of the connecting rods articulated to the second ammunition conveyor. The connecting means for the second ammunition conveyor are in this case indirectly connected to the actuator, via the connecting means for the first ammunition conveyor.

Such a configuration makes it possible to place the actuator on one side of said plane of symmetry, for example in the vicinity of one of the ammunition magazines, and thus not to hinder access to the weapon chamber, while ensuring the synchronization of the movements, in phase opposition, of the conveyors. The integration of the reloading device on existing weapon architectures is therefore easy, since it does not require any modification of the weapon support in the area behind the breech.

Alternatively, each connecting means associated with an ammunition conveyor can be connected directly to the actuator, which can then possibly be arranged on said plane of symmetry, equidistant from the two deformable parallelograms. For example, the actuator will be a rotary actuator as described above, the output shaft of which carries two drive wheels each connected by a link to a driven wheel secured to a pivot itself secured to a first end of one of the connecting rods.

Preferably, third and fourth links each connect two driven wheels that are each secured to a respective one of the two pivots secured to the first ends of the two connecting rods articulated to the same ammunition conveyor. These third and fourth links also help to synchronize the movements of the ammunition conveyors in phase opposition.

The device according to the present invention may further include a stop device for stopping a base of a piece of ammunition ejected from the breech of the weapon after firing, the stop device including a door slidably mounted, preferably in a direction perpendicular to said plane of symmetry, in a frame located behind the breech and adapted to be moved between a stop position, in which the door is aligned behind the breech and at a distance therefrom, and a retracted position, in which the door clears access to the breech so as to allow reloading of the weapon, the movement of the door being synchronized with the movement of the ammunition conveyors by additional movement means connecting the door and the actuator and configured to place the door in the retracted position when either of the ammunition conveyors is in the ready-to-load position and to place the door in the stop position when both ammunition conveyors are in an intermediate position, referred to as the firing position, between the collection and ready-to-load positions.

For example, the door is secured to a chain wound around two wheels that are arranged at the two ends of the frame and one of these wheels is secured to a shaft capable of being driven in rotation by a wheel itself driven in rotation by a link connecting it to a wheel secured to one of the pivots secured to the first ends of the connecting rods, preferably to a wheel secured to the pivot to which said first driven wheel is secured, the additional movement means including said chain, the link and these wheels.

Each of the above-mentioned links advantageously has characteristics that prevent slippage between the link and the wheels, thus guaranteeing the synchronization of the device over time in intensive use. In this respect, a chain and toothed wheel drive is considered very satisfactory.

The present invention also relates to a weapon system, in particular a turret or an artillery piece, including a weapon support and, mounted thereon, a weapon, two ammunition magazines and a device for automatically reloading the weapon, characterized in that the automatic reloading device is as defined above.

The ammunition magazines may be barrels each including a plurality of cells evenly distributed about the axis of rotation of the barrel and each intended to receive one piece of ammunition. The collection area will be formed by the cell that is located in the angular position that is aligned with the ammunition conveyor in the collection position.

BRIEF DESCRIPTION OF THE DRAWINGS

The invention will be better understood from the following description of particular embodiments, which description is made with reference to the attached drawings, in which:

FIG. 1 is a schematic top perspective view of a weapon system according to a first particular embodiment of the invention;

FIG. 2 is a schematic top view of the weapon system of FIG. 1, with the reloading device in a first configuration for reloading the weapon;

FIG. 3 is a schematic top view of the weapon system of FIG. 1, with the reloading device in a firing configuration;

FIG. 4 is a schematic top view of the weapon system of FIG. 1, with the reloading device in a second position for reloading the weapon;

FIG. 5 is a side view of a portion of the weapon system of FIG. 1, showing a portion of the movement means; and FIG. 6 is a schematic front view of a portion of a weapon system according to a second particular embodiment of the invention.

DETAILED DESCRIPTION OF THE INVENTION

FIGS. 1 to 5 show a weapon system 1 with automatic reloading according to a first particular embodiment of the present invention.

The weapon system 1 here includes a weapon 100 mounted on a turret 110, of which only a surface of its movable part 111, namely the weapon mount 111, has been shown, of a military vehicle such as a battle tank, on which are mounted first and second ammunition magazines 120, 130, containing ammunition M, and a reloading device 2.

The weapon 100 conventionally includes a weapon barrel 101, the longitudinal axis of which is the axis A1 of the weapon 100, and a breech 102 through which a piece of ammunition M can be loaded into the weapon 100 for firing. As is well known, the weapon 100 will be orientable in elevation and in relative bearing.

In a conventional manner, the magazines 120, 130 are arranged symmetrically with respect to the vertical plane passing through the axis A1 and are each a rotating magazine, or barrel, including a plurality of cylindrical cells 121, 131, each of which contains a piece of ammunition M.

Each magazine 120, 130 is positioned so that the longitudinal axis of each piece of ammunition M received in a chamber 121, 131 is parallel to the axis A1 of the weapon 100, when the latter is in the loading position. The expression "loading position" refers to the position that the weapon 100 assumes during the operation of loading a piece of ammunition M into the weapon 100.

In the first particular embodiment, the collection area 122, 132 of each magazine 120, 130 is formed by the uppermost cell 121, 131, and the longitudinal axis of the piece of ammunition M received in this cell 121, 131, which coincides with the longitudinal axis A2 of the latter, is at the same height as the axis A1 of the weapon 100 when the latter is in the loading position.

The magazines 120, 130 may incorporate any suitable means for moving the piece of ammunition M out of the collection area 122, 132, as for example described in patent EP 0,051,119 B1.

The reloading device 2 includes first and second ammunition conveyors 3, 4, a single actuator 5, movement means 6 for alternately and synchronously moving the ammunition conveyors 3, 4 between collection, firing and ready-to-load positions, and a stop device 7 for stopping the base of a piece of ammunition that is ejected after firing.

The first and second ammunition conveyors 3, 4 are associated with the first and second magazines 120, 130, respectively, in the sense that each ammunition conveyor 3, 4 is intended to pick up a piece of ammunition M from the collection area 122, 132 of the respective magazine 120, 130 and move in space the piece of ammunition M until it is positioned opposite the breech 102 and in alignment with the axis A1, so as to enable it to be loaded into the weapon 100.

Thus, each ammunition conveyor 3, 4 incorporates means allowing at least the piece of ammunition M it carries to be moved from the ammunition conveyor 3, 4 to the interior of the breech 102. Reference may be made, for example, to the ammunition conveyor described in German patent DE 3,328,208 or patent application FR 3,092,907 A1.

Each ammunition conveyor 3, 4 may thus include a stretcher 30, 40, only shown in FIGS. 1 to 4, which serves as a frame on which other means for supporting, wedging, moving, etc., the piece of ammunition M may be mounted. The stretcher 30, 40 is in the form of a semi-cylindrical body, the longitudinal axis A3 of which coincides with the longitudinal axis of the piece of ammunition M that it carries.

The movement means 6 include, for each ammunition conveyor 3, 4, a pair of connecting rods 60 that are parallel, of the same length and each articulated, at a first end 60*a*, to the turret 110 and, at a second end 60*b*, to the respective ammunition conveyor 3, 4, from below the latter. In particular, the connecting rods 60 are articulated by pivot connections whose pivots 61 are orthogonal to the axis A1 of the weapon 100 when the latter is in the loading position.

The pair of connecting rods 60 and the respective ammunition conveyor 3, 4 thus form a deformable parallelogram allowing the ammunition conveyor 3, 4 to be moved in a theoretical plane which is here perpendicular to said plane of symmetry, by simply pivoting the connecting rods 60, while keeping at all times the longitudinal axis A3 of the ammunition conveyor 3, 4 parallel to the axis A1 of the weapon 100 in the loading position and at the same height as the latter.

The position of each magazine 120, 130, the position of the articulations of the first ends 60*a* of the connecting rods 60 and the length of the connecting rods 60 are thus chosen so that each conveyor 3, 4 can be moved from the collection position to the ready-to-load position, and vice versa, following a circular translation trajectory. In the illustrated embodiment, this means that the articulation axes of the first ends of a pair of connecting rods 60 lie on a straight line parallel to the axis A1 of the weapon 100 in the loading position.

The actuator 5, which is here a rotary actuator such as a motor, for example hydraulic or electric, whose output shaft 50 is parallel to the pivots 61, is used to control the pivoting of the connecting rods 60.

For this purpose, the actuator 5 is located behind the breech 102, laterally to the opening through which a piece of ammunition M can be loaded there, such as in the vicinity of the first magazine 120.

As can be better seen in FIG. 5, the alternating rotational motion that the actuator 5 outputs is transmitted by a chain transmission to the pivot 61 connecting the first end 60*a* of the connecting rod 60 closest to the actuator 5 to the turret 110, in this case a connecting rod articulated to the first ammunition conveyor 3. The chain transmission includes a first drive toothed wheel 62 mounted on the output shaft 50 of the actuator 5, a first driven toothed wheel 63 secured to the pivot 61, itself secured to the connecting rod 60, and a first chain 64 wound on the toothed wheels 62, 63.

The alternating rotation of said pivot 61 is transmitted to the symmetrical pivot 61 of the other deformable parallelogram, again by a chain transmission including a second driven toothed wheel 65 secured to the pivot 61 carrying the first driven sprocket 63, a third driven toothed wheel 66 secured to the symmetrical pivot 61, and a second chain 67 wound on the second driven toothed wheel 65 and the third driven toothed wheel 66.

Moreover, for each pair of connecting rods 60, the two pivots 61 used to articulate the first ends 60*a* of the connecting rods 60 to the turret 110 are also connected to each other by a chain 68, wound around driven toothed wheels 69 secured to said pivots 61.

It is therefore easy to understand that a rotation in one direction, output by the actuator 5, results in a rotation, in the same direction, of the four pivots 61 of the articulations of the first ends 60*a* of the connecting rods 60, and thus in a pivoting of the latter in said direction of rotation, and consequently in a circular translational movement of the ammunition conveyors 3, 4.

The movement of the two deformable parallelograms is synchronized with the movement of the stop device 7.

The stop device 7 includes a door 70, a frame 71 and a chain 72.

The door 70 is in the form of a plate, which may be rectangular as shown or have a substantially rectangular central portion and top and bottom portions wider than the central portion, or vice versa.

The frame 71 is a rectangular frame defining a substantially rectangular opening 71*a*. The frame 71 is dimensioned such that it extends, in the horizontal direction orthogonal to the axis A1, at least from one end to the other of the breech 102.

As illustrated, the door 70 and the frame 71 are preferably inclined downward relative to the vertical, i.e., the side of the door 70 that faces the breech 102 faces downward.

The door 70 is mounted in the frame 71 so as to be slidable between a retracted position, in which the door 70 is clear of the longitudinal axis of the breech 102 and is located alternately on the first magazine 120 side or on the second magazine 130 side, and a stop position, in which the door 70 is located behind and facing the chamber of the breech 102.

As can be better seen in FIG. 5, the sliding movement of the door 70 is controlled by the chain 72, to which the door 70 is attached and which is wound around two toothed wheels 73, of which only one has been shown, at the ends of the frame 71. One of the toothed wheels 73 is secured to a shaft 74 rotating about an axis parallel to that of the pivots 61, and the shaft 74 carries another toothed wheel 75 around which is wound a chain 76 which is, on the other hand, wound around a toothed wheel 77 secured to the pivot 61 closest to the actuator 5.

It is therefore easy to understand that a rotation in one direction, output by the actuator 5, results not only in simultaneous movements of the ammunition conveyors 3, 4, but also in a translational movement of the door 70.

The various parts of the weapon system 1 and its reloading device 2 are arranged so that, during each operating cycle, the reloading device 2 successively occupies a first reloading configuration in which a piece of ammunition M from the first magazine 120 can be moved from the ammunition conveyor 3 to the chamber 102 for loading into the weapon 100, a firing configuration in which the piece of ammunition M loaded in the weapon 100 is fired, and a second reloading configuration in which a piece of ammunition M from the second magazine 130 can be moved from the ammunition conveyor 4 to the chamber 102 in order to be loaded in the weapon 100.

Referring to FIG. 2, the weapon system 1 is in the first reloading configuration.

The door 70 is then in a retracted position on the first magazine 120 side, the first ammunition conveyor 3 is in a ready-to-load position and the second ammunition conveyor 4 is in a collection position. Thus, in this first reloading configuration, the piece of ammunition M carried by the first ammunition conveyor 3 can be loaded into the weapon 100 while the second ammunition conveyor 4 collects a piece of ammunition M from the second magazine 130.

It may be noted here that, when the longitudinal axis A3 of the first ammunition conveyor 3 is aligned with the axis A1 of the weapon 100, the two connecting rods 60 associated with the first ammunition conveyor 3 are oriented perpendicular to the axis A3, and that when the longitudinal axis A3 of the second ammunition conveyor 4 is aligned with the axis A2 of the collection area 132 of the second magazine 130, the two connecting rods 60 associated with the second ammunition conveyor 4 form an angle with respect to the axis A3, so that the second ammunition conveyor 4 is in the vicinity of the pivots 61 connected to the turret 110.

Referring to FIG. 3, the weapon system 1 has moved from the first reloading configuration to the firing configuration.

In this firing configuration, the door 70 is in the stop position and the first and second ammunition conveyors 3, 4 are in an intermediate position between their ready-to-load and collection positions.

In order to move from the first reloading configuration to the firing configuration, the actuator 5 output a rotational motion, clockwise when looking at FIGS. 2 and 3, which results in a pivoting of all the connecting rods 60 in the same clockwise direction, and thus in the movement of the first ammunition conveyor 3 towards its collection position and of the second ammunition conveyor 4 towards its ready-to-load position, while keeping the orientation of the axes A3 of the ammunition conveyors 3, 4 unchanged.

In the illustrated firing configuration, the ammunition conveyors 3, 4 are located substantially next to each other on either side of the axis A1, with their weapon-side end 100 behind the stop device 7, the connecting rods 60 forming an angle with the axis A3 of the respective ammunition conveyor 3, 4 and being symmetric with the connecting rods 60 of the other ammunition conveyor 3, 4 with respect to said plane of symmetry.

The rotational motion output by the actuator 5 also causes the door 70 to slide to the stop position. In this manner, during the ejection of the base of the piece of ammunition M following a firing, the base is stopped by the door 70 which deflects it, in particular thanks to its inclination, towards a base container 78 arranged under the stop device 7 and in which the ejected bases are collected.

Referring to FIG. 4, the weapon system 1 has moved from the firing configuration to a second reloading configuration.

In this second reloading configuration, the door 70 is in a retracted position on the second magazine 130 side, the second ammunition conveyor 4 is in a ready-to-load position and the first ammunition conveyor 3 is in a collection position. Thus, in this second reloading configuration, a piece of ammunition M carried by the second ammunition conveyor 4 can be loaded into the weapon 100 and the first ammunition conveyor 3 collects a piece of ammunition M from the first magazine 120.

It may be noted here that, similarly to the first reloading configuration, when the longitudinal axis A3 of the second ammunition conveyor 4 is aligned with the axis A1 of the weapon 100, the two connecting rods 60 associated with the first ammunition conveyor 4 are oriented perpendicular to the axis A3, and that when the longitudinal axis A3 of the first ammunition conveyor 3 is aligned with the axis A2 of the collection area 122 of the second magazine 120, the two connecting rods 60 associated with the first ammunition conveyor 3 form an angle with respect to the axis A3, such that the first ammunition conveyor 3 is in the vicinity of the pivots 61 connected to the turret 110.

It is easy to understand that, in order to move from the firing configuration to the second reloading configuration, the actuator 5 outputs a rotational motion, clockwise when looking at FIGS. 3 and 4, which results in a pivoting of all the connecting rods 60 in the same clockwise direction, and thus in the movement of the first ammunition conveyor 3 to its collection position and of the second ammunition conveyor 4 to its ready-to-load position. In a similar manner, the door 70 is made to slide to a retracted position on the second magazine 130 side.

Once reloading of the weapon 100 has been accomplished with the second ammunition conveyor 4, the actuator 5 rotates the connecting rods 60 counterclockwise when looking at FIGS. 2 through 4, to return the weapon system 1 to a firing configuration similar to that shown in FIG. 3. Once firing has been done, the actuator 5 rotates again the connecting rods 60 counterclockwise until the weapon system 1 is returned to the first reloading configuration shown in FIG. 2.

Referring now to FIG. 6, it can be seen that therein a portion of a weapon system according to a second particular embodiment has been shown very schematically, which serves to simply illustrate that the present invention is not limited to moving ammunition conveyors by means of a deformable parallelogram as described above.

In the second embodiment, the two ammunition conveyors 3', 4', and more generally the architecture of the weapon system, such as the positioning of the barrels, are similar to those described in patent EP 0,051,119 B1, i.e. they are moved between the collection and ready-to-load positions by pivoting about a pivot axis A5.

More particularly, each ammunition conveyor 3', 4' includes a tubular part 30', 40', used to transport a piece of ammunition, carried by a first end of an arm 31', 41' whose other end is pivotally mounted about the pivot axis A5, for example on a cradle as in patent EP 0,051,119 B1.

The pivoting of each arm 31', 41' is controlled by a chain transmission including two driving toothed wheels 62', mounted on the output shaft of the single actuator 5', such as a rotary motor, two driven toothed wheels 63', each secured to one of the arms 31', 41' and arranged so that its axis coincides with the pivot axis A5, and two chains 64' each wound on one of the driving toothed wheels 62' and the respective driven toothed wheel 63'. The single actuator 5' is arranged at a lower height than the weapon 100 and such that the axis of its output shaft lies in the vertical plane passing through the axis A1 of the weapon 100.

In order to ensure that the two ammunition conveyors 3', 4' pivot alternately, they are arranged so that their alternating pivotings are in phase opposition, and it is readily understood that when one of the ammunition conveyors 3', 4' pivots up, the other pivots down, and vice versa. Therefore, again when one of the conveyors 3', 4' is in the ready-to-load position, the other conveyor 3', 4' is in the collection position, as shown in FIG. 6.

It can thus be seen that the present invention makes it possible to control, with a single actuator, the movement of two ammunition conveyors in phase opposition for an alternating feeding of the weapon, as well as the movement of the door of the base stop device.

The reloading device according to the present invention is therefore particularly simple and inexpensive.

It is understood that the particular embodiment just described is illustrative and non-limiting, and that modifications may be made without departing from the present invention.

For example, the weapon system 1 could be an artillery piece, not a turret.

The invention claimed is:

1. An automatic reloading device for a weapon, the weapon being mounted on a weapon support and the weapon being configured to be fed with ammunition by two ammunition magazines that are carried by the weapon support and that each have a collection area having a longitudinal axis along which, in use, a piece of ammunition to be loaded extends, the collection areas being symmetric on either side of a vertical plane of symmetry passing through an axis of the weapon, the automatic reloading device including:

a first ammunition conveyor and a second ammunition conveyor, each movable between a collection position, in which the ammunition conveyor is able to collect a piece of ammunition from a collection area of a respective one of the two ammunition magazines, and a ready-to-load position, in which the ammunition conveyor is able to load said piece of ammunition into a breech of the weapon, drive means for moving the first and second ammunition conveyors between the collection and ready-to-load positions in such a way as to ensure alternating feeding of the weapon by the first and second ammunition conveyors, the first and second ammunition conveyors following trajectories that are symmetric with respect to said plane of symmetry, the movements of the first and second ammunition conveyors from the collection position to the ready-to-load position, and vice versa, being identical, except for the symmetry, wherein the drive means include:

a single actuator, secured to the weapon support and able to output an alternating motion, and movement means for transmitting the alternating motion to the first and second ammunition conveyors and converting the alternating motion into movements of the first and second ammunition conveyors for an alternating feeding of the weapon.

2. The automatic reloading device according to claim 1, wherein the ammunition conveyors each have a longitudinal axis that belongs to a plane parallel to said plane of symmetry, and the movement means include, for each ammunition conveyor:

a pair of parallel connecting rods, of the same length and each having first and second ends articulated to the weapon support and to the ammunition conveyor, respectively, so as to form with the ammunition conveyor a deformable parallelogram in a theoretical plane that intersects said plane of symmetry, the alternating movements of each of the first and second ammunition conveyors between the collection position and the ready-to-load position being obtained by alternating pivotings of the pair of connecting rods about their first ends; and connecting means connected to the actuator and to the deformable parallelogram so as to obtain said alternating pivoting of the pair of connecting rods when the actuator outputs said alternating motion.

3. The automatic reloading device according to claim 2, wherein the two pairs of connecting rods form two deformable parallelograms in the theoretical plane.

4. The automatic reloading device according to claim 3, wherein each connecting rod is articulated to the weapon support and to a respective ammunition conveyor by means of pivot connections.

5. The automatic reloading device according to claim 4, wherein:

the actuator is a rotary actuator having a rotary output shaft whose longitudinal axis is parallel to pivots of the pivot connections;

the connecting means for the first ammunition conveyor include a first link connecting a first drive wheel secured to the output shaft and a first driven wheel secured to a pivot secured to the first end of one of the connecting rods articulated to the first ammunition conveyor; and the connecting means for the second ammunition conveyor include a second link connecting a second driven wheel secured to a pivot secured to the first end of one of the connecting rods articulated to the first ammunition conveyor, and a third driven wheel secured to a pivot secured to the first end of one of the connecting rods articulated to the second ammunition conveyor.

6. The automatic reloading device according to claim 5, wherein third and fourth links each connect two driven wheels that are each secured to a respective one of the two pivots secured to the first ends of the two connecting rods articulated to the respective ammunition conveyor.

7. The automatic reloading device according to claim 5, wherein the automatic reloading device further includes a stop device for stopping a base of a piece of ammunition ejected from the breech of the weapon after firing, the stop device including a door slidably mounted in a frame located behind the breech and adapted to be moved between a stop position, in which the door is aligned behind the breech and at a distance therefrom, and a retracted position, in which the door clears access to the breech so as to allow reloading of the weapon, the movement of the door being synchronized with the movement of the ammunition conveyors by additional movement means connecting the door and the actuator and configured to place the door in the retracted position when either of the ammunition conveyors is in the ready-to-load position and to place the door in the stop position when both ammunition conveyors are in an intermediate position between the collection and ready-to-load positions, and wherein the door is secured to a chain wound around two wheels that are arranged at two ends of the frame and one of these wheels is secured to a shaft capable of being driven in rotation by a wheel driven in rotation by a link connecting the wheel driving the shaft in rotation to a wheel secured to one of the pivots secured to the first ends of the connecting rods, the additional movement means including said chain, the link, the two wheels that are arranged at the two ends of the frame, the wheel driving the shaft in rotation, and the wheel secured to one of the pivots.

8. The automatic reloading device according to claim 7, wherein the link is selected from the group formed by a belt and a chain.

9. The automatic reloading device according to claim 5, wherein each link is selected from the group formed by a belt and a chain.

10. The automatic reloading device according to claim 1, wherein the automatic reloading device further includes a stop device for stopping a base of a piece of ammunition ejected from the breech of the weapon after firing, the stop device including a door slidably mounted in a frame located behind the breech and adapted to be moved between a stop position, in which the door is aligned behind the breech and at a distance therefrom, and a retracted position, in which the door clears access to the breech so as to allow reloading of the weapon, the movement of the door being synchronized with the movement of the ammunition conveyors by additional movement means connecting the door and the actuator and configured to place the door in the retracted position when either of the ammunition conveyors is in the ready-to-load position and to place the door in the stop position when both ammunition conveyors are in an intermediate position between the collection and ready-to-load positions.

11. A weapon system comprising the weapon support and the weapon mounted on the weapon support, two ammunition magazines and an automatic reloading device for automatically reloading the weapon, wherein the automatic reloading device is as defined in claim 1.

12. The weapon system according to claim 11, wherein the weapon system is a turret.

* * * * *